US010918149B2

(12) United States Patent
Pilipenka

(10) Patent No.: US 10,918,149 B2
(45) Date of Patent: Feb. 16, 2021

(54) ARTICLE OF APPAREL

(71) Applicant: Under Armour, Inc., Baltimore, MD (US)

(72) Inventor: Natalia Pilipenka, New York, NY (US)

(73) Assignee: UNDER ARMOUR, INC., Baltimore, MD (US)

( * ) Notice: Subject to any disclaimer, the term of this patent is extended or adjusted under 35 U.S.C. 154(b) by 47 days.

(21) Appl. No.: 15/911,616

(22) Filed: Mar. 5, 2018

(65) Prior Publication Data

US 2018/0255852 A1 Sep. 13, 2018

Related U.S. Application Data

(60) Provisional application No. 62/469,056, filed on Sep. 3, 2017.

(51) Int. Cl.
*A41D 27/24* (2006.01)
*A41D 27/10* (2006.01)
(Continued)

(52) U.S. Cl.
CPC ..... *A41D 27/24* (2013.01); *A41D 27/10* (2013.01); *A41H 3/00* (2013.01); *D04B 1/24* (2013.01); *D10B 2501/06* (2013.01)

(58) Field of Classification Search
CPC ..... A41D 27/24; A41D 27/10; A41H 3/00; D04B 1/24; D10B 2501/06; A41B 1/00;
(Continued)

(56) References Cited

U.S. PATENT DOCUMENTS 1,202,332 A * 10/1916 Tschirgi ..... A41D 1/04 2/115
1,890,385 A * 12/1932 Karahadian ..... A41D 1/04 2/90

(Continued)

OTHER PUBLICATIONS

"Illusion Floral Lace Yoke Split Bow Back Top." Women & Men's Clothing,us.romwe.com/Illusion-Floral-Lace-Yoke-Split-Bow-Back-Top-p-241548-cat-670.html. (Year: 2017).*

(Continued)

*Primary Examiner* — Jillian K Pierorazio
(74) *Attorney, Agent, or Firm* — Edell, Shapiro & Finnan, LLC

(57) ABSTRACT

A textile shirt and a method of forming a shirt from a textile material are described herein. The method includes marking a surface of a circularly formed textile structure with a boundary line that defines approximately half of a shirt pattern. Portions of the textile structure disposed exteriorly of the boundary line are removed and the boundary line is marked along the surface of the textile structure such that once the portions are removed from the textile structure, a shirt can be formed from the textile structure with a single seam. The shirt includes a yoke portion including armholes defined by sleeves disposed on either side of the yoke portion and a tubular torso portion configured to span the torso of a wearer beneath the armholes. The shirt includes a single interior seam extending along the sleeves and along a back of the textile shirt between the yoke portion and the chest portion.

13 Claims, 4 Drawing Sheets

(51) Int. Cl.
*D04B 1/24* (2006.01)
*A41H 3/00* (2006.01)

(58) Field of Classification Search
CPC .. B26F 1/00; B26D 5/005; D06H 7/08; D06H 7/24; D06H 5/005; D06H 5/001; D06H 5/006
USPC ..... 2/106, 90; 66/169 R, 170; D2/828, 840
See application file for complete search history.

(56) References Cited

U.S. PATENT DOCUMENTS 2,072,050 A * 2/1937 Sharps ..... A41D 1/04 2/90
2,121,168 A * 6/1938 Hibshman ..... A41D 1/04 2/90
2,332,134 A * 10/1943 De Marco ..... A41B 1/02 2/122
2,798,225 A * 7/1957 Jacobson ..... A41B 1/00 2/115
3,272,046 A * 9/1966 Crouch ..... B26F 1/00 83/310
3,561,009 A * 2/1971 Huggins ..... A41D 1/04 2/90
3,664,156 A * 5/1972 Betts ..... A41H 3/00 66/176
3,675,246 A * 7/1972 Ito ..... A41D 1/00 2/115
3,675,604 A * 7/1972 Frost ..... A41H 42/00 112/475.07
RE27,886 E * 1/1974 Johnson ..... A41B 11/14 66/177
4,304,007 A * 12/1981 Ito ..... A41D 1/04 2/108
D263,890 S * 4/1982 Dalton ..... D2/849
4,473,908 A * 10/1984 Knecht ..... A41B 1/00 2/114
4,587,671 A * 5/1986 Rodriguez, Jr. ..... A41D 27/10 2/114
4,608,719 A * 9/1986 Lunt ..... A41D 13/1209 2/114
4,635,301 A * 1/1987 Sulser ..... A41H 3/00 2/69
4,649,573 A * 3/1987 Yen ..... A41H 3/00 2/108
4,852,187 A * 8/1989 Johansson ..... A41D 13/1236 2/69
4,937,883 A * 7/1990 Shirai ..... A41D 1/04 2/113
5,083,315 A * 1/1992 Dillon, Jr. ..... B01D 57/02 2/114
5,198,288 A * 3/1993 Grunfeld ..... D04B 1/18 442/306
5,605,060 A * 2/1997 Osborne ..... A41C 3/0014 2/69
5,758,363 A * 6/1998 Winfree ..... A41D 1/04 2/108
6,154,883 A * 12/2000 Spann ..... A41D 13/1245 2/114
6,250,115 B1 * 6/2001 Suzuki ..... D04B 1/246 66/171
6,330,814 B1 * 12/2001 Fujiwara ..... D04B 1/246 66/8
6,389,850 B1 * 5/2002 Fujiwara ..... D04B 1/24 66/171
6,550,287 B1 * 4/2003 Sherrill ..... A41D 1/04 2/113
D488,291 S * 4/2004 Gerson ..... D2/840
2001/0042389 A1 * 11/2001 Fujiwara ..... D04B 21/06 66/196
2005/0079795 A1 * 4/2005 Faircloth ..... A41C 3/0014 450/65
2005/0115281 A1 * 6/2005 Mitchell ..... D04B 1/246 66/176
2008/0078009 A1 * 4/2008 Black ..... A41D 27/10 2/115
2010/0199406 A1 * 8/2010 Dua ..... A43B 1/04 2/115
2016/0060807 A1 * 3/2016 Tharpe ..... B23K 26/352 264/400
2018/0228231 A1 * 8/2018 Johnson ..... A41D 1/04

OTHER PUBLICATIONS

YouTube, YouTube, www.youtube.com/watch?v=tbB61DJ6zgs. (Year: 2013).*
YouTube, YouTube, www.youtube.com/watch?v=0u62ASNNqUU. (Year: 2013).*
YouTube, YouTube, www.youtube.com/watch?v=gB7HAkURk64&t=293s. (Year: 2013).*
YouTube, YouTube, www.youtube.com/watch?v=Noc-cRk6seU. (Year: 2013).*
"How to Cut Knit Fabric." Tilly and the Buttons, www.tillyandthebuttons.com/2014/02/how-to-cut-knit-fabric.html. (Year: 2014).*
Henkell, Joyce, et al. "When It Goes Against the Grain." Patterns for Pirates, Nov. 14, 2017, www.patternsforpirates.com/grainline/. (Year: 2017).*
"How to Cut Knit Fabric", Tilly and the Buttons. Feb. 26, 2014. https://www.tillyandthebuttons.com/2014/02/how-to-cut-knit-fabric.html (Year: 2014).*
McCall's 7114 Girls'/Girls' Plus Tops, Dress, Leggings and Headband, retrieved Wayback Machine, Mar. 21, 2015, https://web.archive.org/web/20161012185217/http://sewing.patternreview.com/Patterns/71445 (Year: 2015).*
"Hem" Dictionary.com. Web. https://www.dictionary.com/browse/hem.*

* cited by examiner

ARTICLE OF APPAREL

CROSS-REFERENCE TO RELATED APPLICATIONS

This application claims priority under 35 U.S.C. § 119(e) to U.S. Provisional Patent Application Ser. No. 62/469,056, entitled "Article of Apparel," filed Mar. 9, 2017, the disclosure of which is incorporated herein by reference in its entirety for all purposes.

FIELD OF THE INVENTION

The present invention is directed toward an article of apparel and, in particular, to a shirt formed form a single blank of fabric.

BACKGROUND

Articles of apparel, such as shirts may be formed from textiles of various materials. In a conventional process, a shirt is formed by attaching (i.e., sewing) different sections or panels (i.e., a front panel, a back panel, a yoke panel, sleeves, etc.) to each other. Consequently, conventional shirts often have a plurality of seams or joints formed therein. Seams not only increase production costs, but introduce friction (chafing) points into the article of apparel, decreasing wearing comfort. Thus, it would be desirable to provide an article of apparel that minimizes the number of seams within its structure.

BRIEF SUMMARY

In accordance with example embodiments of the present invention, a textile shirt and a method of forming a shirt from a textile material are described herein. The method includes forming a textile via circular knitting, thereby forming a tube. The structure of the tube defines an upper or yoke portion and a lower or trunk portion. The textile tube is laid flat and selected tube portions are removed therefrom. In the resulting shirt, the yoke portion includes armholes defined by sleeves disposed on either side of a neck opening, while the trunk portion remains a continuous tube. A single seam is used to form the sleeves and couple a back of the yoke portion to a back of the trunk portion.

BRIEF DESCRIPTION OF THE DRAWINGS

Like numbers have been utilized to identify like components throughout the figures.

DETAILED DESCRIPTION

Figure 1B:
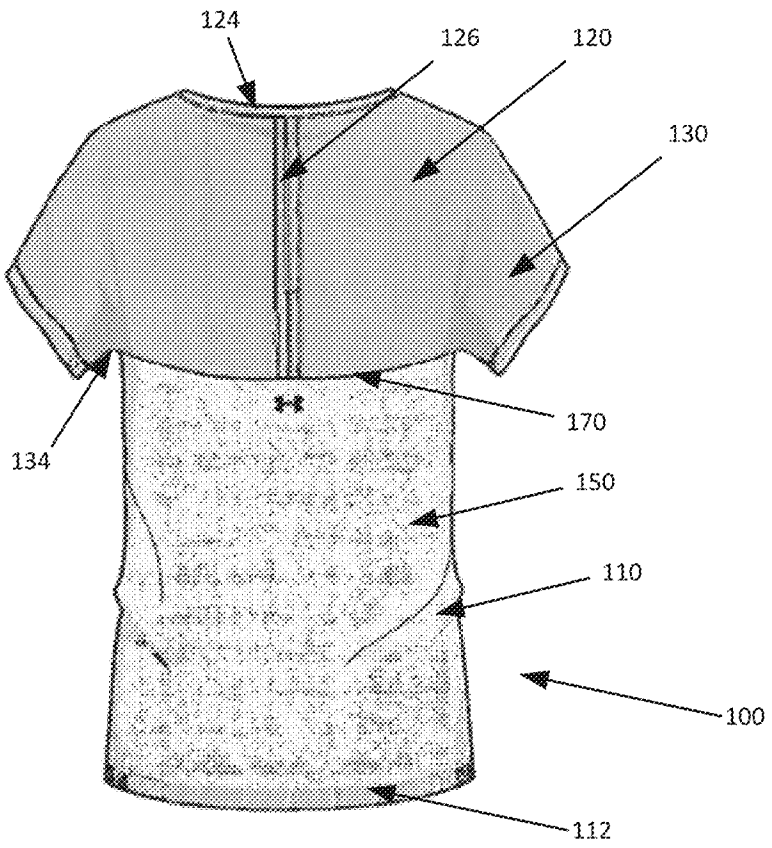
FIGS. 1A and 1B depict exterior views of a front and a back, respectively, of a shirt formed in accordance with an example embodiment of the present invention.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

In accordance with the present invention, a process for forming textile shirts includes forming a textile with a particular patterning defined along a surface of the textile (also referred to herein as a fabric). The patterning is applied to a circularly formed textile in order to form a shirt pattern that can be formed into a shirt with a single interior seam or joint (insofar as an interior seam refers to seams running in or through the shirt, as opposed to hems that run along exterior edges of the shirt). The patterning may also be configured to minimize an amount of waste or unused material for the textile and provide certain physical characteristics for the shirt formed from the textile. Generally, textiles used to form a shirt in accordance with the present invention are formed circularly via any suitable process, including knitting (i.e., circular knit), weaving, forming nonwovens, etc., as is described in further detail below in connection with FIG. 3.

By comparison, conventional shirts that are formed from a number of panels or sections typically require a plurality of seams and/or joints. Each seam and/or joint may incrementally increase the cost of manufacturing a shirt and may also create issues with the fit, durability, and comfort (i.e., seams may limit the elasticity or stretch in a certain area and may deteriorate faster than the material to which the seam is sewn or joined). Seams and/or joints may also introduce inconsistencies across a product line when attempting to mass produce shirt. Further, when a plurality of shirts are formed from a number of different panels or sections, forming each panel may generate waste in the form of unused fabric material. The techniques for forming a shirt with a single interior seam presented herein avoid such disadvantages and facilitate rapid and uniform production of shirts with minimal wasted material.

Figure 1A:
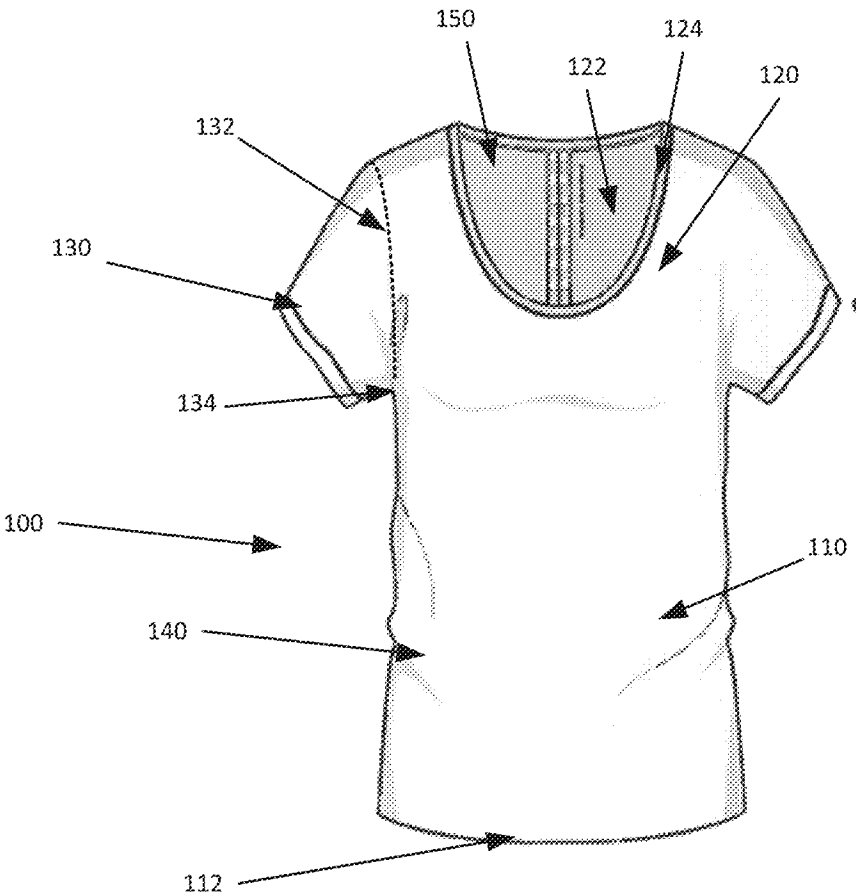

Now referring to FIGS. 1A and 1B, a description is provided of a shirt 100 formed in accordance with the techniques presented herein. In FIGS. 1A and 1B, an exterior of the shirt 100 is shown. FIG. 1A shows the exterior from a front view and FIG. 1B shows the exterior from a back view. As can be seen, shirt 100 includes a lower torso portion 110, an upper chest or yoke portion 120 defining left and right arm sleeves 130. The sleeves 130 extend from the chest portion 120, from (and around) armholes 132 (shown in dashed lines for clarity, although no seam is present between the sleeves 130 and chest portion 120) to distal ends (which may each be bordered by a hem). The torso portion 110 extends from bottom hem 112 to a bottom edge 134 of the armholes 132. By comparison, the chest or yoke portion 120 is defined above the bottom edge 134 of the armholes 132. Put another way, the torso portion 110 defines a waist dimension of shirt 100 and the yoke portion 120 defines a chest dimension of shirt 100. The yoke portion 120 also defines a neck opening 122 that is bordered by a collar 124 (i.e., a hem).

Collectively, the torso portion 110, the chest or yoke portion 120, and the sleeves 130 define a front 140 and back 150 of the shirt 100. In different embodiments, the front 140 and back 150 may be have different colors, textures, etc.; however, as is described in further detail below, the front 140 and back 150 are formed from a single piece of material that is patterned in such a way that a single seam 170 can be used to form the shirt 100. As can be seen in FIG. 1B, the seam 170 extends between the torso portion 110 and the yoke portion 120 on the back 150 of the shirt 100. The seam 170 also extends past the armholes 132, along the underside (or bottom) of the sleeves 130. The combination of the seam 170, the patterning of the blank used to form the shirt, and the collar 124 create a vertical opening 126 in the back 150 of the yoke portion 120. More specifically, the yoke portion 120 includes two subportions that extend upwards from a top edge of the torso portion 110 at the front 140 of the shirt. Each portion of the yoke 120 extends over the shoulder and down the back 150, where the seam 170 is used to couple a free edge of the subportions of the yoke 120 to the torso portion 110 at the back 150 of the shirt 100. The free edge of each portion of the yoke 120 is coupled to the top edge of the torso portion 110 at the back 150, but the two subportions are separated vertically along a central portion of the back 150 (i.e., between the collar 124 and the top edge of the back 150 of the torso portion 110) due to the alignment of the shirt pattern on a single piece of circularly formed material. That is, due to the shirt pattern, the vertical opening 126 substantially bisects the back 150 of the shirt 100. Applying the shirt pattern to a single piece of circularly formed material allows this feature to be created while forming the shirt with a single, linear seam, as is explained in further detail below.

Figure 2:
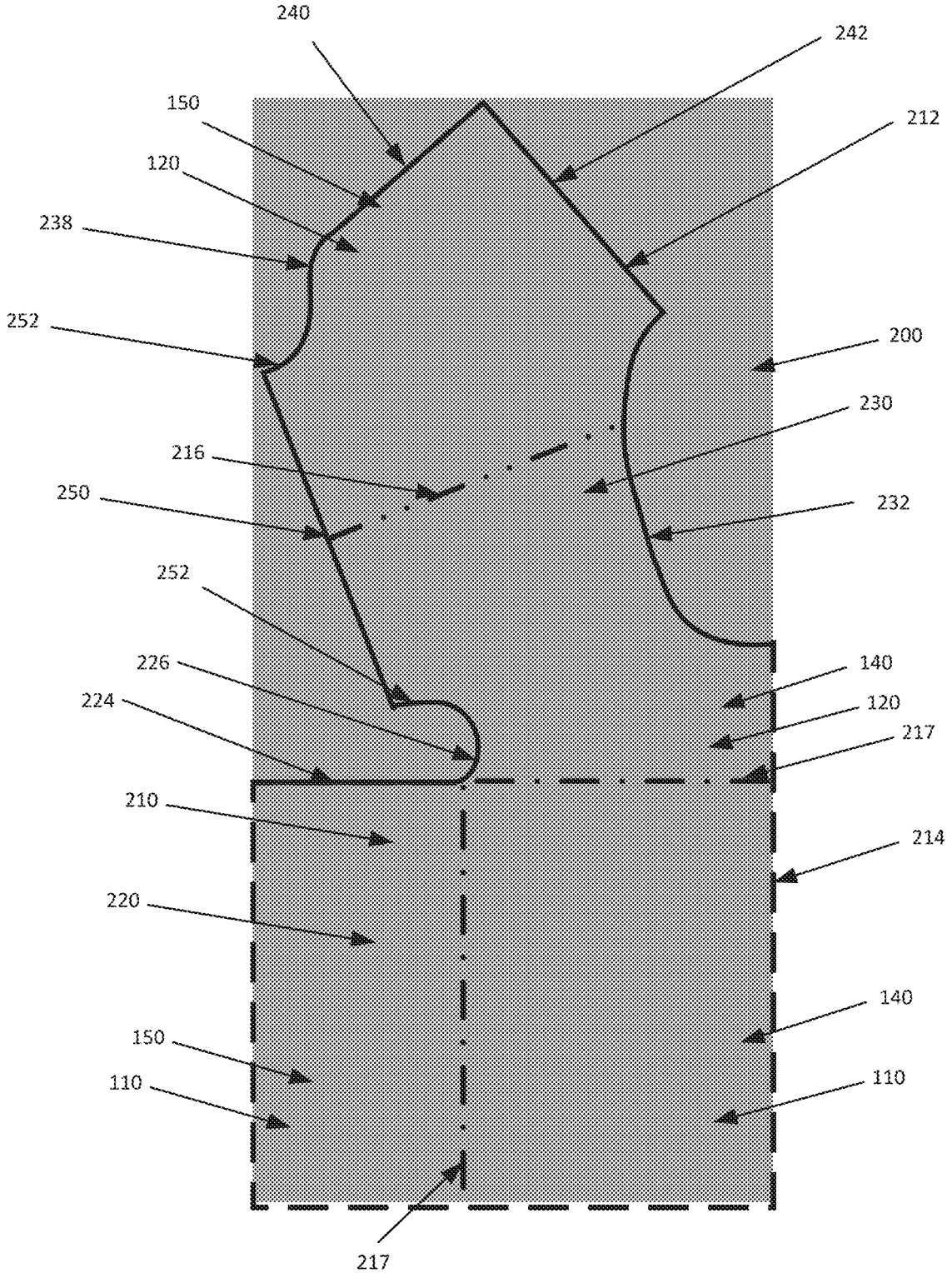
FIG. 2 depicts a textile structure including a boundary line marked thereon, the boundary line defining portions of the textile which are to be removed to form the shirt of FIG. 1 in accordance with example embodiments of the present invention.

Now referring to FIG. 2 for a description of a length of fabric 200 including a structure 210 defined along a surface of the fabric 200. Although not depicted in FIG. 2, the fabric 200 is a circularly formed fabric (i.e., circular knit fabric) and, thus, the fabric 200 is tubular (i.e., includes two layers when laid flat). The structure 210 is defined within a boundary line 212 (shown in solid and dashed lines, but not represented by the dashed lines with dots) on the fabric 200 and is intended to provide a shirt pattern that extends through both layers of the fabric 200. That is, the pattern provided by boundary lines 212 defines approximately half of a shirt, so that, collectively, the two layers of the circular fabric 200 define a structure 210 that is a shirt pattern. The structure 210 is formed from the fabric 200 by removing the fabric outside of the boundary line 212. Notably, in FIG. 2, a portion 214 of the boundary line 212 is dashed (without any dots, i.e., "----"). These dashed portions 214 are aligned with an edge of the fabric 200 and, thus, no portion of the fabric immediately adjacent the dashed portion of boundary line 212 is outside of the boundary line 212. That is, no cut is required along the dashed portions 214 of boundary line 212 (e.g., a cutting machine may move around the fabric at these locations or avoid these locations altogether). Consequently, for clarity, portions 214 may be referred to herein as no-cut lines.

Generally, the boundary line 212 can be defined along the surface of the fabric 200 in any suitable manner (i.e., providing printed indicia on the fabric surface, including printed boundary line portions, providing one or more alignment markings on the fabric surface that facilitates alignment of the fabric surface with a cutting device, providing a suitable alignment of the fabric surface with a die cutting machine, etc.) that facilitates removal of fabric outside of the boundary line 212 via any suitable automated or other process. As an example of a removal method, in rapid or speed forming of the shirt from a fabric material, the fabric outside of the boundary line 212 can be removed from the fabric structure via an automated cutting process, such as a laser cutting process. An automated cutting process, such as a laser cutting process, can utilize alignment markings provided on the fabric surface or any other type of markings to align a laser (or other) cutting device with the fabric surface to facilitate cutting of the fabric along the defined boundary line 212 to form the shirt pattern. A laser cutting process, i.e., can utilize a computer programmed pattern that moves the cutter of the laser cutting device in the pattern of boundary line 212 to form the shirt pattern. In another example embodiment, a machine/die cutting process can be utilized, where a cutting machine removes fabric outside of the boundary line 212 based upon an alignment of cutting components of a cutting device with the fabric 200. Thus, the boundary lines defined along the surface of the fabric 200 simply represent the cuts to be made to the fabric to separate or remove portions, in any suitable manner, from the fabric 200. Consequently, the boundary lines 212 may or may not represent actual printed lines or markings on the fabric surface.

Still referring to FIG. 2, but now with continued reference to FIGS. 1A and 1B for a description of the structure 210 defined by the boundary line 212 with respect to the shirt 100 shown in FIGS. 1A and 1B. However, before describing the specific features of the boundary line 212, it is noted that in FIG. 2, a reference line 216 is included (a dash-dot-dot-dash line, with the pattern "-..-") to show where the fabric 200 might be folded to form the shirt 100 from the pattern provided by the boundary line 212. The reference line 216 generally denotes a top edge or shoulder of shirt 100; however, in at least some embodiments, the reference line 216 need not be included as a part of boundary line 212. Instead, the top edge or shoulder may form naturally as the seam 170 is sewn or otherwise installed onto the shirt 100.

Additionally, FIG. 2 also includes reference lines 217 (dash-dot lines, with the pattern "-.-") so that different portions of the shirt 100 can be identified in FIG. 2. Specifically, the front 140 and back 150, as well as the yoke section 120 and torso section 110 are labeled in FIG. 2 with respect to reference lines 216 and 217.

Now to further describe the structure 210 defined by the boundary line 212, the structure 210 includes a number of features that enable the shirt 100 to be formed with a single seam. However, the features depicted in FIG. 2 are not to scale and may be altered in various embodiments, provided these features collectively form the sleeves 130 and chest or yoke section 120 of the shirt 100. Initially, the structure includes a bottom section 220 (i.e., the section defined by non-cut lines 214) that spans the width of the fabric 200. Since the fabric 200 is a circular fabric, a section of the structure 210 that spans the width provides a tubular portion of fabric. Consequently, in the depicted embodiment, the bottom section 220 defines a tubular portion that forms the torso portion 110 of the shirt 100, including the front 140, the back 150 and any sides extending therebetween.

Moving upwards in FIG. 2, the structure 210 also includes an upper section 230 (i.e., the portions of structure 210 defined by solid portions of boundary line 212) that includes a number of arcs, corners, and other such features that collectively form the sleeves 130 and chest or yoke portion 120 of the shirt 100. For example, the upper section 230 includes sleeve length sections 252 and sleeve end section 250 that define the sleeves 130 and an arc 232 that defines the neck opening in the chest portion 120. In different embodiments, these features (i.e., sections 232, 250, and 252) may be shaped and sized as desired. For instance, the arc 232 that defines the neck opening 122 may have any size or shape to provide different neck designs (i.e., a V-neck design or crew neck) and sleeve length section 252 may have any desirable length to provide sleeves of different length (provided the sleeves fit within the width of the circular fabric 200).

Most notably, however, the upper section includes a top edge 240 and top arc 238 that are configured to mate with a top edge 224 and arc 226 of the lower portion 220 (which may also be referred to as the lower edge 224 and arc 226 of the upper portion 230) so that a single seam (i.e., seam 170) can be installed into fabric 200 to form shirt 100 from the shirt pattern provided by structure 210. However, since the upper section 230 does not span the width of the fabric 200, the upper section 230 will include two pieces or subportions after the fabric 220 is cut along the boundary line 212 (i.e., after outside or exterior of the boundary line 212 are removed). By comparison, the lower portion 220 spans the width and, thus, includes a top edge 224 that is continuous around the front 140 and back 150 of the shirt. Consequently, the top edge top edge 240 and top arc 238 of each piece or subportion of the yoke 120/top portion 230 must be aligned with the top edge 224 and arc 226 of the lower portion 220/torso 110 in order to align these portions for coupling with a single seam 170.

More specifically, the edge 240 of each subportion is folded or otherwise moved into alignment with edge 224 to form an approximately horizontal seam across the back 150 of shirt 100 (as shown in FIG. 1B) while the arc 238 of each subportion is folded or otherwise moved into alignment with a respective arc 226 (formed on opposite sides of the shirt) to form the bottom 134 of each armhole 132 (as shown in FIG. 1B). Once these sections are aligned (i.e., the edges 240 of each piece/subportion of the yoke 120 are aligned with edge 224 and the arcs 238 of each piece/subportion of the yoke 120 are aligned with their respective arc 226), the sections can be sewn together with a single seam 170, such as a overlock join seam, to form the shirt (i.e., complete the shirt except for any final hemming or design details along the exterior edges of the shirt 100). Moreover, the seam 170 also extends along the sleeves 130 to form length sections 252 into tubular sleeves. To facilitate this, the sleeve length sections 252 of each subportion of the yoke section 120 align (i.e., form a continuous line) with either sections 224 and 226 or sections 238 and 240. Thus, it may be said that the single interior seam 170 extends from the end of one sleeve to the end of the other sleeve.

The aforementioned mating and coupling (i.e., sewing) with seam 170 also vertically aligns an edge 242 of each subportion of the upper section 230 on the back 150 of the yoke portion 120 of shirt 100 so that edges 242 form borders of the vertical opening 126. Since the pattern of the boundary line 212 defines half of a shirt pattern, two edges 242 are formed from a single cut and the two edges 242 (and, thus, the vertical opening 126) will be substantially centered on the back 150 of the shirt (which may align with the left of the fabric 200 in FIG. 2). That is, the vertical opening 126 will substantially bisect the back 150 of the shirt 100. In some embodiments, the edges 242 can further be connected in any suitable manner to form a seam at such edges (thus eliminating the opening 126 that would otherwise exist between the two edges 242).

Still referring to FIG. 2, the design and alignment of structure 210 on fabric 200 not only enables a shirt (i.e., shirt 100) to be formed with a single seam, but also minimizes the steps involved in manufacturing and the amount of waste produced during manufacturing (in the form of unused fabric material/fabric waste, such as portions of the fabric 200 that are left and unused when the portions of the fabric 200 outside the boundary line 212 are removed from the fabric 200). Ideally, it is desirable to define the shirt pattern structure 210 along the fabric surface so as to utilize as much of the fabric material as possible, thus avoiding or minimizing fabric waste. With the embodiments of the present invention, the fabric 200 can be cut with a single cut or as few as two cuts in order to trim the fabric 200 down to the boundary line 212, and these cuts leave minimal waste. For example, as much as 70% or greater, preferably 80% or greater, more preferably 90% or greater, and even more preferably 95% or greater of the fabric material is utilized to form the textile shirt. This results in a minimization of waste of fabric material (i.e., portions of the fabric 200 that are outside of the boundary lines defining structure 210) to be no greater than 30%, preferably no greater than 20%, more preferably no greater than 10%, and even more preferably no greater than 5%.

Figure 3:
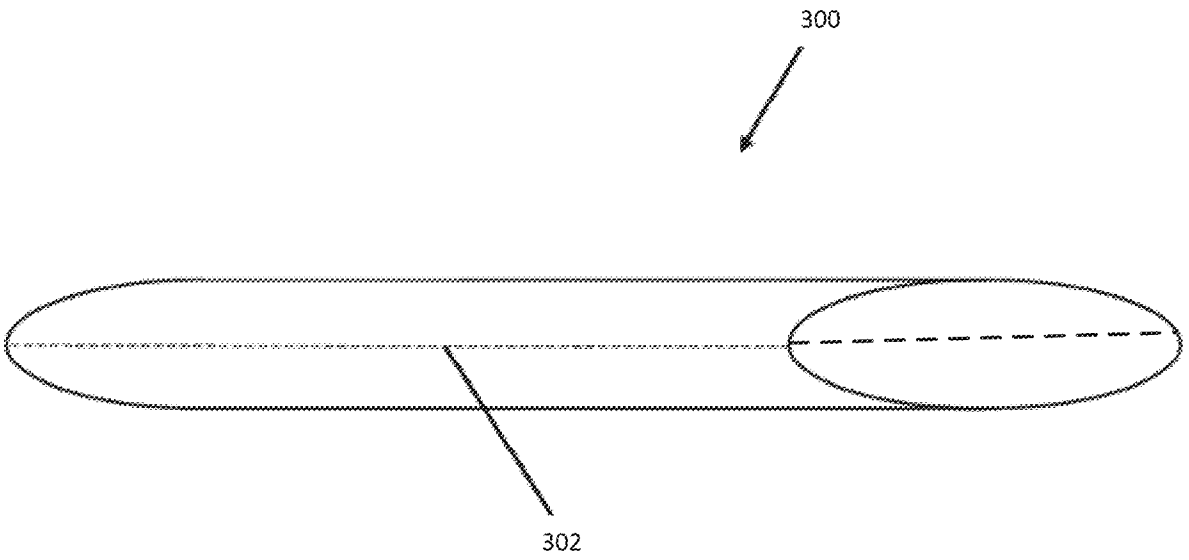
FIG. 3 depicts an example embodiment of a circular knit structure for use in forming the shirt of FIG. 1, in accordance with example embodiments of the invention.

Now referring to FIG. 3, as mentioned, the fabric structure 200 utilized in the present invention is a circularly formed textile formed utilizing any suitable technique. For example, fabric structure 200 may be formed utilizing a circular knit process. A circular knit process results in the formation of a tubular knit structure 300 which can be folded in half, i.e., along fold line 302, to form a substantially flat, two-layer fabric structure 200, as shown in FIG. 2. Knitting is a process for constructing fabric by interlooping one or more yarns. In general, knitting includes warp knitting and weft knitting. In warp knitting, the yarns generally run lengthwise in the fabric (i.e., tricot, milanese, and raschel knitting). In weft knitting, one continuous thread runs crosswise in the fabric making all of the loops in one course. Weft knitting includes both circular knitting and flat knitting. In circular knitting, the fabric is produced on the knitting machine in the form of a tube, with the threads running continuously around the fabric. By comparison, in flat knitting, the fabric is produced on the knitting machine in flat form, the threads alternating back and forth across the fabric. A plaited knit structure can also be formed which includes an interior layer or face and an exterior layer or face formed of the same or varying strands and/or stitches. Both the interior and exterior layers are formed concurrently by knitting a plaited construction so that the layers are distinct, yet integrated one with the other.

The textile may comprise any suitable number (i.e., one or more) and/or types of strands. The term strand includes a single fiber, filament, or monofilament, as well as an ordered assemblage of textile fibers having a high ratio of length to diameter and normally used as a unit (i.e., slivers, roving, single yarns, plies yarns, cords, braids, ropes, etc.). In an example embodiment, a strand comprises a yarn (a continuous strand of textile fibers, filaments, or material in a form suitable for knitting, weaving, or otherwise intertwining to form a textile fabric). A yarn may include a number of fibers twisted together (spun yarn), a number of filaments laid together without twist (a zero-twist yarn), a number of filaments laid together with a degree of twist, and/or a single filament with or without twist (a monofilament).

Strands used to form the textile or fabric can be natural strands (i.e., cotton strands, wool strands, silk strands, etc.) and/or synthetic strands formed of one or more types of polymers, including fibers or filaments having one or more polymer components formed within the fibers or filaments. Some non-limiting examples of materials that may be utilized in the spun staple and/or continuous filament hard yarns include cotton, polyester (i.e., polyethylene terephthalate, polybutylene terephthalate, etc.), polyamides (i.e., nylon), polyolefins (i.e., polypropylene, polyethylene, etc.), acrylics, wool, acetate, polyacrylonitrile and/or any combinations thereof. Natural fibers can include, i.e., cellulosic fibers (i.e., cotton, bamboo) or protein fibers (i.e., wool, silk, and soybean).

The strands can be elastic or non-elastic strands, or strands can be provided that have varying degrees of elasticity. An elastic strand possesses elasticity and/or recovery, i.e., the ability to recover its original size and shape immediately after removal of a stress (i.e., after stretching) causing deformation (the degree to which fibers, yarn, or cord returns to its original size and shape after deformation indicates how well a fabric recovers). An elastic strand, by virtue of its composition, possesses the ability to stretch. Some specific examples of elastic polymer components suitable for forming an elastic strand include, without limitation, elastomeric polyester-polyurethane copolymers such as elastane, which is a manufactured fiber in which the fiber-forming substance is a long chain synthetic polymer composed of at least 85% of segmented polyurethane.

Non-elastic strands possess little to no elasticity. Strands formed of hard fibers and strands formed of high tensile strength filaments are examples of non-elastic strands. Hard yarns are yarns that are substantially non-elastic. That is, hard yarns include knitting yarns which possess little to no elastic stretch, such as natural and/or synthetic spun staple yarns, natural and/or synthetic continuous filament yarns, and combinations thereof. Some non-limiting examples of materials that may be utilized in the spun staple and/or continuous filament hard yarns include cotton, polyester, nylon, polypropylene, polyethylene, acrylics, wool, acetate, polyacryonitrile, and combinations thereof. Natural fibers include cellulosic fibers (i.e., cotton, bamboo) or protein fibers (i.e., wool, silk, and soybean). They also can be of mono component poly(ethylene terephthalate) and poly(trimethylene terephthalate) fiber, polycaprolactam fiber, poly (hexamethylene adipamide) fibers acrylic fibers, modacrylic, acetate fibers, rayon fibers, nylon and combinations thereof.

It should be understood that while non-elastic yarns do not possess elasticity, they may be made resilient via texturing. For example, crimping a polyester filament permits the filament to expand from its normal position to an expanded position upon application of force. Upon removal of the force, the filament returns to its normal position.

The various types of strands that can be used to form a textile structure for mass producing or speed forming shirts can be incorporated within the textile structure so as to vary certain properties of the textile structure at different locations of the textile structure, which in turn will result in the shirts formed from the textile structure having such properties. Additionally or alternatively, the textile structure can be formed so that different portions of the shirt have different properties or aesthetics. For example, a first portion of the textile structure that will form the front of the shirt may have a first texture and second color while a second portion of the textile structure that will form the back of the shirt may have a second texture and second color.

Figure 4:
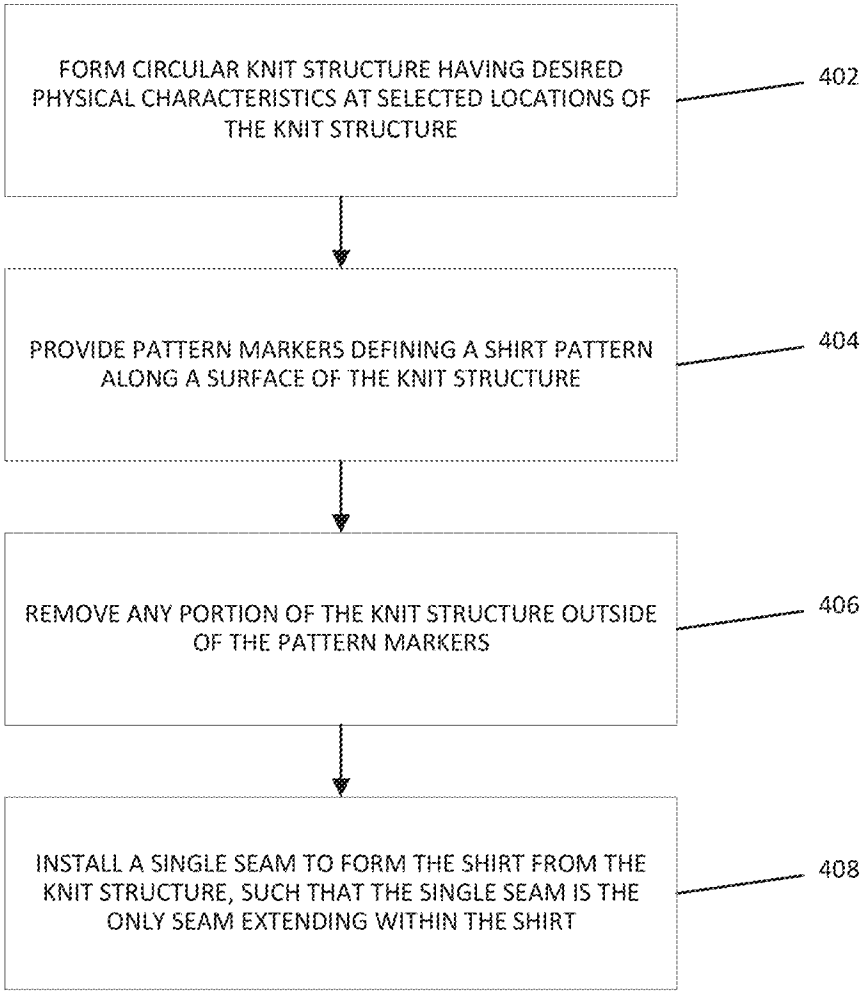
FIG. 4 is a flowchart depicting an example process for forming the shirt of FIG. 1 in accordance with example embodiments of the present invention.

An example speed forming process for forming a plurality of textile uppers is now described with reference to the flowchart of FIG. 4. In this example embodiment, a circular knit fabric structure is formed, and this structure is utilized to form a shirt (i.e., shirt 100). However, in other example embodiments, a circular textile structure can also be formed via any other process (weaving, nonwoven process, etc.) and utilized in accordance with the present invention to form a shirt with a single, interior seam. At step 402, a knit fabric structure (i.e., fabric 200 as depicted in FIG. 3) is formed via any suitable circular knit process. During this process, strands of different colors or properties may be combined to form a shirt with various appearances or properties. For example, the circuit knit fabric may be configured to provide a front of a first color and/or pattern, a back torso portion of a second color and/or pattern, and a back yoke section of a third color and/or pattern.

At step 404, pattern markers define the upper structures (i.e., define the boundary lines within which the upper structures are located, where the boundary lines locate where patterned portions of the knit fabric structure are removed) are provided (i.e., as depicted in FIG. 2). Such markers can be printed or defined in any other suitable manner along a surface of the knit fabric structure, as discussed above in connection with FIG. 2. Alternatively, or in combination with printed markers, markers can simply be physical alignments between the knit fabric structure and a tool die cutting or similar type of machine that removes the upper structure patterns from the fabric structure. At step 406, any portion of the knit fabric structure outside of the pattern markers is removed, i.e., by cutting the fabric 200 along the boundary line. As discussed above in connection with FIG. 2, the separation can be achieved via any suitable automated or other separation technique (i.e., laser cutting, mechanical cutting, etc.).

At step 408, a shirt (i.e., shirt 100) is substantially completed or formed with a single seam (i.e., seam 170). As is discussed above in connection with FIG. 2, the seam runs along the back of the shirt, between the torso portion and the yoke portion of the shirt, and beneath the sleeves. This seam leaves an opening in the back of the shirt, which is intended to be an aesthetic opening down the back of the wearer. Once the seam 170 is installed, the shirt is substantially completed; however, in at least some instances, the shirt may be finished with some exterior hems (i.e., along the outer edge of the sleeves and/or the edges of the vertical opening). Thus, the techniques provided herein facilitates rapid formation (i.e., in a manufacturing facility that produces shirts) of shirts while minimizing waste or non-used material in a textile structure due to the patterning and alignment of the shirt on the textile structure.

It is therefore intended that the present invention covers the modifications and variations of this invention provided they come within the scope of the appended claims and their equivalents. It is to be understood that terms such as "top," "bottom," "front," "rear," "side," "height," "length," "width," "upper," "lower," "interior," "exterior," "medial," "lateral," and the like as may be used herein, merely describe points of reference and do not limit the present invention to any particular orientation or configuration. Moreover, while the invention has been described in detail and with reference to specific embodiments thereof, it will be apparent to one skilled in the art that various changes and modifications can be made therein without departing from the spirit and scope thereof.

What is claimed:

1. A method of forming a shirt from a textile material, comprising:

marking a surface of a circularly formed textile structure with a boundary line that defines approximately half of a shirt pattern, wherein the shirt pattern comprises a lower portion defining a tubular torso portion and an upper portion with two subportions that define a yoke portion;

removing portions of the textile structure disposed exteriorly of the boundary line; and once the portions are removed from the textile structure, forming a shirt from the textile structure with a single interior seam that extends from one sleeve end to a second sleeve end through only a back of the shirt, the single interior seam coupling each of the two subportions to the lower portion in a manner that provides a vertical opening in the back of the shirt and forms sleeves from the yoke portion.

2. The method of claim 1, further comprising:

installing the single interior seam between a back of the tubular torso portion of the shirt and a back of the yoke portion of the shirt.

3. The method of claim 2, wherein installing further comprises:

installing the single interior seam beneath the sleeves defined by the yoke portion to form tubular sleeves from the shirt pattern.

4. The method of claim 1, wherein the upper portion further defines a neck opening and the method further comprises:

hemming the neck opening, hemming distal ends of the sleeves, and hemming a bottom edge of the tubular torso portion to finish the shirt.

5. The method of claim 1, wherein the lower portion spans a width of the textile structure and the boundary line provides no-cut lines around the lower portion.

6. The method of claim 1, further comprising:

folding the two subportions of the upper portion to align upper edges of the two subportions with an upper edge of the lower portion; and the coupling comprises coupling the upper edges of the two subportions to the upper edge of the lower portion with the single interior seam.

7. The method of claim 1, wherein the vertical opening bisects the back of the shirt.

8. The method of claim 1, wherein the marking comprises providing one or more indicia on the surface of the textile structure that facilitates alignment of a cutting device with the textile structure.

9. The method of claim 1, wherein the removing comprises cutting along the boundary line with two or fewer cuts.

10. The method of claim 1, wherein the removing removes no greater than 30% of the textile structure.

11. The method of claim 1, wherein the removing comprises cutting with an automated cutting process.

12. The method of claim 1, further comprising:

forming the circularly formed textile structure with a circular knit process.

13. The method of claim 12, wherein the circular knit process utilizes one or more of: (1) natural strands and synthetic strands; (2) elastic strands and non-elastic strands; and (3) first color strands and second color strands, to form the circularly formed textile structure so that a first portion of the shirt has a first texture or first color and a second portion of the textile structure has a second texture or second color.

* * * * *